United States Patent [19]

Matino

[11] 4,235,001

[45] Nov. 25, 1980

[54] GAS DISPLAY PANEL FABRICATION METHOD

[76] Inventor: Haruhiro Matino, 9-32-205, 5-chome, Kugenmakaigan, Fujisawa-Kanagawa, Japan

[21] Appl. No.: 900,446

[22] Filed: Apr. 27, 1978

Related U.S. Application Data

[63] Continuation of Ser. No. 716,399, Aug. 23, 1976, abandoned.

[30] Foreign Application Priority Data

Sep. 17, 1975 [JP] Japan ..... 50-111717

[51] Int. Cl.[3] ..... H01J 9/02

[52] U.S. Cl. ..... 29/25.14; 29/25.17; 316/20

[58] Field of Search ..... 316/24, 20, 19; 204/38 A; 29/25.13, 25.17, 25.18, 25.14

[56] References Cited

U.S. PATENT DOCUMENTS

| | | | |
|---|---|---|---|
| 3,499,167 | 3/1970 | Baker et al. | 313/188 X |
| 3,559,190 | 1/1971 | Bitzer et al. | 313/201 X |
| 3,646,384 | 2/1972 | Lay | 313/109.5 |
| 3,737,341 | 6/1973 | Croset et al. | 156/37 |
| 3,787,106 | 1/1974 | Schermerhorn | 316/17 |
| 3,789,470 | 2/1974 | Owaki | 316/19 X |
| 3,805,210 | 4/1974 | Croset et al. | 204/38 A |
| 3,808,497 | 4/1974 | Greeson, Jr. et al. | 313/182 |
| 3,825,454 | 7/1974 | Kikuchi et al. | 156/8 |
| 3,827,776 | 8/1974 | Nakayama | 316/20 |

*Primary Examiner*—Richard B. Lazarus
*Attorney, Agent, or Firm*—Joseph J. Connerton

[57] ABSTRACT

A gas panel fabrication method includes forming a first set of dielectrically coated parallel conductors on a glass plate, forming a metal spacer layer over the first conductors, oxidizing those areas of the metal spacer layer which are between the first conductors, forming a second set of dielectrically coated parallel conductors over the spacer layer in orthogonal relationship with the first conductors, etching the unoxidized areas of the spacer layer from between the second conductors, and forming a cover plate to hold an ionizable gas adjacent to the orthogonal conductors.

13 Claims, 5 Drawing Figures

GAS DISPLAY PANEL FABRICATION METHOD

This is a continuation of application Ser. No. 716,399 filed Aug. 23, 1976 and now abandoned.

BACKGROUND OF THE INVENTION

1. Field of the Invention

The present invention relates generally to a method for fabricating a flat display panel and more particularly to a method for fabricating a gas display panel with a monolithic structure. 2. Description of the Prior Art In the prior art, display panels employing gas discharge are well known and a variety of such display panels have already been suggested. A typical structure of a gas display panel utilizes a pair of glass plates. A plurality of parallel conductors are formed on one surface of each of said glass plates. Preferably, the conductors are dielectrically coated to utilize the memory action by wall charges. The glass plates are placed so that the conductors on one glass plate are opposite to and orthogonal to the conductors on the other glass plate. Spacer means such as rods is placed between the glass plates at their peripheral portions thereby to define a distance between the conductors opposite to each other and accordingly a discharge gap. The intersections of the orthogonal conductors form display cells. The peripheral portions of the glass plates are sealed to form a gas discharge chamber including an ionizable gas. An example of a method of fabricating a gas display panel with such a structure is disclosed in the Japanese laid-open patent application No. 79972/73.

However, when the discharge gap is defined by placing such spacer rods at the peripheral portions of the panel, it is liable to cause variations in the discharge gap between the central portions and the peripheral portions of the panel due to the somewhat flexible nature of the glass plates. This inclination would be more marked especially in larger panels. Since a firing voltage is a function among other things of the discharge gap, such variations in the discharge gap with the positions of the cells would be a factor of preventing the reliable operation of the panel. If the number of the spacer rods were increased so as to be placed also at the central portions of the panel, the problem of the variations in the discharge gap could be relieved to some extent. However, even if the number of the spacer rods were increased, it would practically be impossible to keep the discharge gap uniform at all the cells due to the limited flatnesses of the glass plates themselves. Further, such incomplete flatnesses of the glass plates would not permit them to be placed quite close to each other, thereby resulting in preventing the increase of the cell density, accordingly the resolution, of the panel. It would be quite difficult and quite uneconomical to try to place the spacer rods precisely and to obtain completely flat glass plates.

Therefore, in order to realize a gas display panel which would provide a highly reliable operation and a higher cell density, it would be required to fabricate a gas display panel such that it would be free from restrictions by the flatnesses of the glass plates as much as possible.

The Japanese laid-open patent application No. 12/72 discloses a gas display panel with a structure wherein both sets of conductors orthogonal to each other are supported on one glass plate. One set of conductors are formed on the glass plate and dielectrically coated. The other set of conductors are formed on the dielectric coating so as to extend orthogonally to said one set of conductors. Then, a cover plate is attached to hold an ionizable gas in the areas adjacent to the sets of conductors orthogonal to each other. In ths gas display panel, said problem of the variations in the discharge gap due to the incomplete flatnesses of the glass plates may be solved since both sets of conductors orthogonal to each other are supported on one glass plate. However, in this gas display panel, gas discharge is produced along the surface of the dielectric coating near the intersections of the orthogonal conductors and cannot be produced perpendicularly to the glass plate at the intersections of the orthogonal conductors since the areas between the sets of conductors orthogonal to each other are completely filled with the dielectric coating. As the result, in this gas display panel, it has been impossible to define the cells clearly, to increase the cell density, and to obtain a high quality in the display.

The Japanese laid-open patent application No. 56059/73 also discloses a gas display panel with a structure wherein the sets of conductors orthogonal to each other having a dielectric coating therebetween are supported on one glass plate, similar to the gas display panel disclosed in said laid-open patent application No. 12/72. In this gas display panel, small cavities or blind holes are formed in the dielectric coating adjacent to the intersections of the orthogonal conductors, one for each of said intersections, thereby to provide a space for gas discharge at each of said intersections. However, in this gas display panel, it is still unable to increase the cell density since said cavities are not aligned with the intersections of the orthogonal conductors.

Further, the Japanese laid-open patent application No. 37073/73 discloses a gas display panel with a structure wherein the sets of conductors orthogonal to each other having a dielectric coating therebetween are supported on one insulating substrate. This gas display panel is provided with holes at the intersections of the orthogonal conductors, one for each of said intersections, which pass through the conductors on the dielectric coating and the dielectric coating to the surfaces of the conductors on the insulating substrate, thereby to provide spaces for gas discharge. These holes located at the intersections of the orthogonal conductors may accomplish the advantage that the spaces for gas discharge may be aligned with the intersections of the orthogonal conductors. However, these conductors are liable to be made wider in order to form such holes therethrough and this would be a problem in obtaining an increased resolution of the panel. Further, in this gas display panel, the memory action by wall charges cannot be utilized since both sets of the conductors are in direct contact with the gas in the panel.

OBJECT OF THE INVENTION

Accordingly, it is a major object of the present invention to provide an improved method for fabricating a flat display panel with a monolithic structure.

It is another object of the present invention to provide a method for fabricating a gas display panel whereby the discharge gas can be kept uniform at all the cells without being restricted by the flatnesses of the glass plates and a high resolution display can be realized.

It is further object of the present invention to provide a method for fabricating a gas display panel whereby one set of conductors are suspended a given distance from the other set of conductors by spacer means so that both sets of conductors orthogonal to each other are integrally supported on one substrate and an ionizable gas exists between the orthogonal conductors at the intersections of the orthogonal conductors.

SUMMARY OF THE INVENTION

A method of fabricating a gas display panel in accordance with the present invention is started with preparing a substrate having on one surface thereof a plurality of elongated first conductors. The first conductors may be dielectrically coated. Then, a spacer layer is formed over said first conductors which comprises first areas of a material removable by a predetermined treatment and second areas of an insulating material unremovable by said treatment with said second areas located between said first conductors. Next, a plurality of elongated second conductors are formed on said spacer layer so as to intersect with said first conductors. The second conductors may be dielectrically coated. Then, said first areas are removed by subjecting them to said treatment from between said second conductors. Finally, a cover plate is attached so as to cover all the intersections of said first and second conductors.

More particularly, in a preferred embodiment of the present invention, a plurality of first parallel conductors are formed on a substrate. Then, a first dielectric coating is deposited over the first conductors. Next, a spacer layer of metal such as aluminium, for example, is deposited over the dielectric coating and the areas thereof between the first conductors where ultimate spacer means is to be formed are oxidized. A second dielectric coating is deposited over the spacer layer comprising the areas of a metal and the areas of a metal oxide and a plurality of second parallel conductors are formed on the second dielectric coating so as to extend orthogonally to the first conductors. A third dielectric coating is deposited over the second conductors. Then, the areas of the second and third dielectric coatings between the second conductors are removed by etching to expose the corresponding areas of the spacer layer. The remaining areas of the second and third dielectric coatings completely cover the top, bottom and lateral surfaces of the second conductors. Thereafter, the exposed areas of the spacer layer between the second conductors are subjected to an etching solution thereby to remove the metal areas of the spacer layer. Finally, a cover plate is attached so as to cover the intersections of the first and second conductors.

In another embodiment of the present invention, more than one of the step of depositing the first dielectric coating, the step of depositing the second dielectric coating, and the step of depositing the third dielectric coating are eliminated and instead thereof the exposed surfaces of the first and/or second conductors are oxidized thereby to form dielectric coatings thereon.

DESCRIPTION OF THE PREFERRED EMBODIMENT

Figure 1:
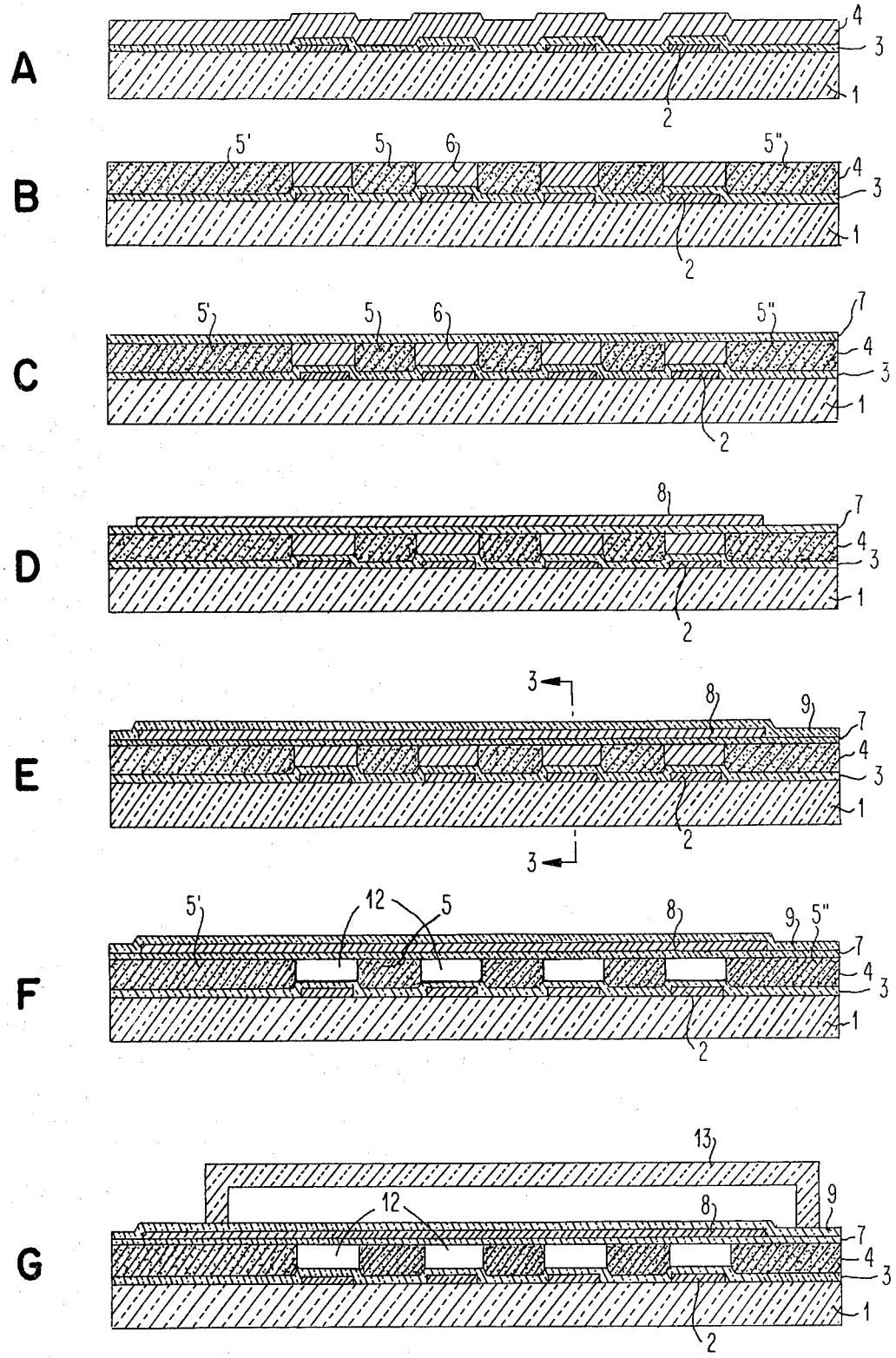
FIG. 1 illustrates the various steps for fabricating a gas display panel in accordance with the present invention.

Referring now to the drawings, the present invention will be explained more in detail with respect to a preferred embodiment thereof. FIG. 1 illustrates various steps for fabricating the gas display panel with a monolithic structure in accordance with the present invention. As illustrated by A in FIG. 1, a plurality of first parallel conductors 2 are formed on an insulating substrate such as a glass plate 1, for example. Only four conductors are shown in FIG. 1 for illustrative purposes. The conductors 2 are formed by vacuum evaporating a metal in a uniform thickness on the top surface of the glass plate 1 and then employing the well known photolithographic masking and etching techniques. Of course, the conductors 2 may be formed also by evaporating a metal with the surface of the glass plate 1 masked selectively so as to expose only the areas where the conductors 2 are to be formed or may be deposited by any other known method. In this embodiment, the conductors 2 are preferably made of a transparent conductive material such as $SnO_2$ or $(In_2O_3+SnO_2)$ since the glass plate 1 is used as a display face. In case $SnO_2$ is used, the conductors 2 are formed by depositing a sputtered $SnO_2$ layer in a thickness of $1\mu$, then selectively masking the $SnO_2$ layer with a photoresist layer in the conductor pattern, and etching the $SnO_2$ layer with hydrochloric acid or sulfuric acid. The conductors 2 are $130\mu$ wide and $40\mu$ spaced apart from each other. The conductors 2 may be formed also by employing electron beam evaporation of $SnO_2$ or by spraying $SnCl_4$ onto a glass plate heated at 400° to 700° C. The conductors 2 may be made of a material such as copper or aluminium bifurcated or provided with small holes at the positions where display cells are to be formed in order to increase the light outputs. When the conductors 2 are made of a highly conductive material such as copper, they may have a thickness of $0.5\mu$. As will be described later more in detail, the conductors 2 are preferably formed so as to be terminated a given distance from each end of the glass plate 1 so that the entire surfaces of the conductors 2 may be dielectrically coated to protect them from subsequent metal etching processes.

Then, a dielectric coating 3 is deposited over the conductors 2. The materials used for the dielectric coating 3 include $SiO_2$, $Al_2O_3$, $Si_4N_4$ and the like. In case of $SiO_2$, the glass plate 1 is heated at a temperature in the order of room temperature to 200° C. and $SiO_2$ is deposited thereon to a thickness of $2\mu$ by RF sputtering. With an RF power of 500 to 1000 W at 13.56 MHz, the deposition rate is about 250 Å/min. and the sputtering is performed for about 80 minutes to obtain an $SiO_2$ layer with a thickness of $2\mu$. Since the conductors 2 are formed so as to be terminated a given distance from each end of the glass plate 1, not only the top surfaces but also the lateral and end surfaces of the conductors 2 may be coated with the dielectric coating 3.

Thereafter, as illustrated by A in FIG. 1, a spacer layer 4 of a metal is deposited over the dielectric coating 3 in a uniform thickness. The metal used therefor may be any of those which would meet the requirements that they may be easily deposited, that they may be easily etched, and that they form highly insulating oxides when oxidized. For this purpose, aluminium is most preferred. Aluminium is deposited by vacuum evaporation under a vacuum pressure of $1\times10^{-6}$ Torr with the glass plate 1 heated at 300° C. The spacer layer 4 of aluminium has a thickness of 10μ. As will be clearly understood later, the spacer layer 4 of aluminium is not deposited to the edges of the conductors 2 which are utilized for external connections to supply driving signals to the conductors 2. Other metals such as tantalum, niobium, zirconium and hafnium may be also used for the spacer layer 4, but they have extremely high melting points and require a sputtering technique to be deposited. The sputtering technique demands relatively precise controls and needs much time to obtain a relatively thick layer due to its low deposition rate. Further, an etching solution of hydrofluoric acid used for etching these metals also etches $SiO_2$ and therefore aluminium is desired to be used for the spacer layer 4. However, these metals may be used for the spacer layer 4 when other metals such as $Al_2O_3$, $Si_4N_4$ and the like which are not etched by hydrofluoric acid are used for the dielectric coating.

Next, as illustrated by B in FIG. 1, the spacer layer 4 of aluminium is selectively oxidized so that only the areas 5 between the conductors 2 and the areas 5' and 5'' at both edges may be oxidized into alumina ($Al_2O_3$). This oxidization is performed by depositing a photoresisit layer over the entire surface of the spacer layer 4 of aluminium, selectively exposing and developing the photoresist layer so that only the areas 5, 5' and 5'' of the spacer layer 4 of aluminium are exposed, and then anodizing the exposed areas of the spacer layer 4 of aluminium. This anodization of aluminium is performed in an aqueous solution of 2% sulfuric acid at a temperature below 20° C. with a current density of 0.01 to 0.02 $A/cm^2$. Aluminium somewhat increases in its thickness when oxidized into alumina. In the figures, the alumina areas 5, 5' and 5'' are shown to be coplanar with the aluminium areas 6 as the result of an increase in the thickness of the alumina areas 5, 5' and 5'', but it should be understood that for the purpose of clarity they are not always showing precisely the actual conditions. It should be understood also that for the purpose of clarity the figures are not always showing the dimensions of each element to the same scale as its actual structure.

Figure 2:
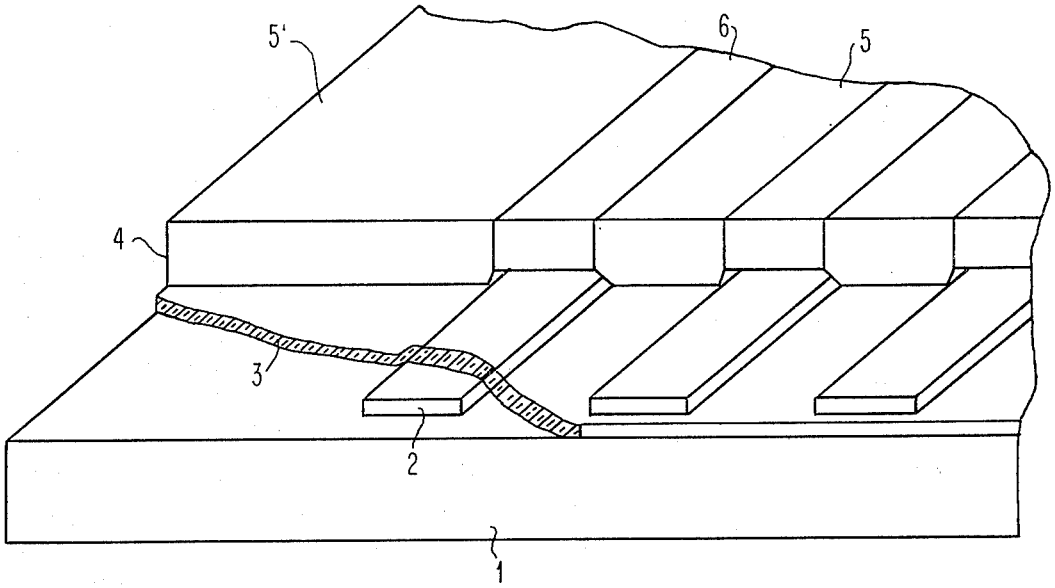
FIG. 2 is an enlarged fragmentary perspective view illustrating the gas display panel at the step of B in FIG. 1.

FIG. 2 is an enlarged fragmentary perspective view illustrating a panel having the spacer layer 4 of aluminium which has been selectively anodized as described above with the dielectric coating 3 partly broken. Since the dielectric coating 3 is transparent, the conductors 2 can be seen therethrough. It will be apparent from FIG. 2 that the conductors 2 are terminated a given distance from each end of the glass plate 1 to be entirely coated with the dielectric coating 3 and that the spacer layer 4 is formed so as not to cover the edges of the conductors 2.

In case the end surfaces of the aluminium areas 6 in stripes are exposed, they will be also oxidized. However, they may be allowed to be oxidized to some extend since they are actually located outside the display area. If desired, the photoresist layer may be deposited so as to cover also the end surfaces of the aluminium areas 6. Alternatively, the periphery of the spacer layer 4 of aluminium located outside the display area may be oxidized in a frame pattern. It is only needed to oxidize the areas of the spacer layer 4 between the conductors 2 where ultimate spacer means is to be formed.

Next, as illustrated by C in FIG. 1, a second dielectric coating 7 is deposited over the spacer layer 4 comprising the alumina areas 5, 5' and 5'' and the aluminium areas 6. The dielectric coating 7 which may be of the same material as the dielectric coating 3 is formed in a thickness of 2μ by RF sputtering as in the case of the dielectric coating 3.

Then, as illustrated by D in FIG. 1, a plurality of second parallel conductors 8 are formed on the dielectric coating 7 so as to extend orthoganally to the conductors 2. The conductors 8 may be formed in the same thickness, the same width and the same spacing with the same material as the conductors 2. However, the conductors 8 may be also made of an opaque conductive material such as copper since the conductors 8 located in the back of the cells formed by the conductors 2 and the conductors 8 will not affect the light outputs. When copper is used for the conductors 8, they are formed in a thickness of 0.5μ. The conductors 8 are formed so as to be terminated a given distance from each end of the spacer layer 4 as illustrated by D in FIG. 1.

Thereafter, as illustrated by E in FIG. 1, a third dielectric coating 9 is deposited over the conductors 8. The dielectric coating 9 which may be of the same material as the dielectric coatings 3 and 7 is formed in a thickness of 2μ by RF sputtering as in the cases of the dielectric coatings 3 and 7. As will be clearly understood later, if the top and lateral surfaces of the conductors 8 are not coated with the dielectric coating 9, these surfaces would be in direct contact with the gas in a completed panel and therefore sputtering would be produced at the exposed surfaces of the conductors 8 during the discharging operation, which might cause the gas in the panel to be contaminated. Therefore, the conductors 8 are preferably coated with the dielectric coating 9. Since the conductors 8 are terminated a given distance form each end of the spacer layer 4, their exposed surfaces may be coated completely with the dielectric coating 9.

Figure 3:
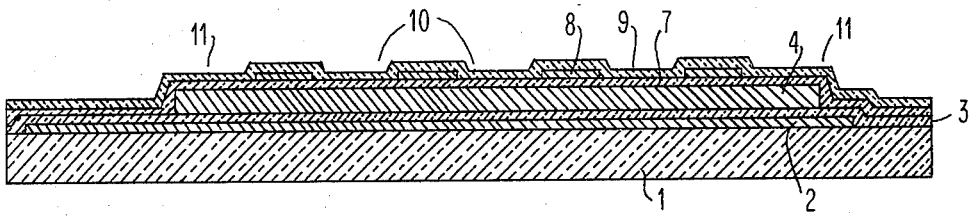
FIG. 3 is a sectional view taken along the line 3—3 of E in FIG. 1.

The next step is to etch selectively the dielectric coatings 7 and 9 so as to expose the spacer layer 4 at the areas between the conductors 8. Referring now to FIG. 3, the Figure is a sectional view taken along the line 3—3 of E in FIG. 1. The areas of the dielectric coatings 7 and 9 to be etched are the areas 10 between the conductors 8 as shown in FIG. 3. Further, in order to facilitate the etching of the aluminium areas at the edges of the spacer layer 4, the dielectric coatings 7 and 9 are preferably etched also in the areas 11. This etching operation is performed by employing the well known photolithographic masking techniques. Namely, a photoresist layer is deposited over the dielectric coating 9 and then selectively exposed and developed so that the photoresist layer in the areas 10 and 11 may be removed. The dielectric coating 9 exposed in the areas 10 and 11 is subjected to an etching solution which effectively etches only the dielectric coatings. A solution of 10% HF or a solution of (10% $HF+NH_4F$) is used as the etching solution.

Figure 4:
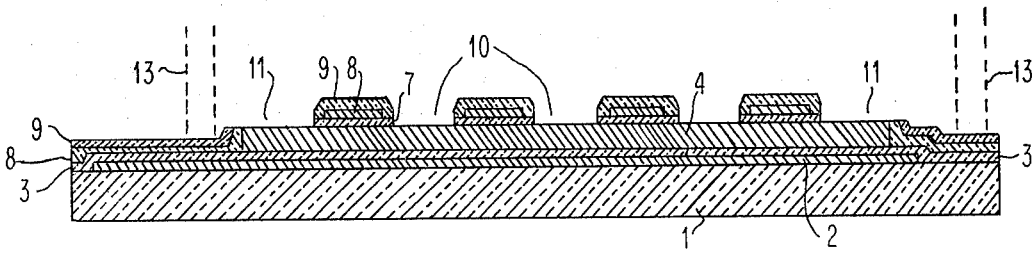
FIG. 4 is a sectional view, similar to FIG. 3, illustrating the gas display panel when the dielectric coatings have been selectively removed by etching.

FIG. 4 is a sectional view, similar to FIG. 3, illustrating the panel when the dielectric coatings 7 and 9 have been selectively removed by etching. The spacer layer 4 is exposed in the areas 10 and 11. The etching of the dielectric coatings 7 and 9 should be performed so that after the etching the conductors 8 are still coated completely with the dielectric coatings 7 and 9.

Next, the panel is subjected to an etching solution to remove the aluminium areas 6 of the spacer layer 4. An etching solution which etches aluminium but not alumina nor a dielectric material is used therefor. For this purpose, etching solutions based on $H_3PO_4$ or NaOH may be utilized and an appropriate etching solution is an aqueous solution of ($H_3PO_4+HNO_3$). As the result, the aluminium areas 6 of the spacer layer 4 are removed by the etching solution which attacks them from the areas 10 and 11 and thereby empty spaces 12 are produced as illustrated by F in FIG. 1. The empty spaces 12 exist between the first or lower conductors 2 and the second or upper conductors 8, and accordingly the upper conductors 8 are suspended a given distance from the lower conductors 2 by the alumina areas 5, 5' and 5'' which act as ultimate spacer means.

In etching the aluminium areas 6 of the spacer layer 4, the dielectrically coated upper conductors 8 partly mask the aluminium areas 6 and act to prevent the areas masked thereby from being etched. However, since the dielectric material and alumina are not substantially etched by the aluminium etching solution, the etching operation may be performed for a long period of time enough to permit the aluminium areas under the upper conductors 8 to be fully undercut thereby. By applying ultrasonic waves, the aluminium areas may be removed more rapidly. Since the conductors 2 and 8 are completely dielectrically coated, they would not be subjected to damage by the aluminium etching solution.

Then, as illustrated by G in FIG. 1 and in FIG. 4, a cover plate 13 is placed at an appropriate position to hold an ionizable gas at the areas of the cells defined by the intersections of the conductors 2 and the conductors 8 and sealed with a sealing material such as a solder glass. The cover plate 13 is attached so that one edges of the conductors 2 and 8 which are utilized for external connections to supply driving signals to the gas panel are extended out of the cover plate 13. When the periphery of the spacer layer 4 of aluminium is oxidized in a frame pattern as described above, the cover plate 13 may be placed on the periphery oxidized in a frame pattern.

Finally, the edges of the dielectric coatings 3, 7 and 9 are removed by etching so as to expose one edges of the conductors 2 and 8 which are utilized for external connections. This etching operation may be performed by immersing the edges of the panel in a solution of 10% HF or a solution of (10% $HF+NH_4F$).

Figure 5:
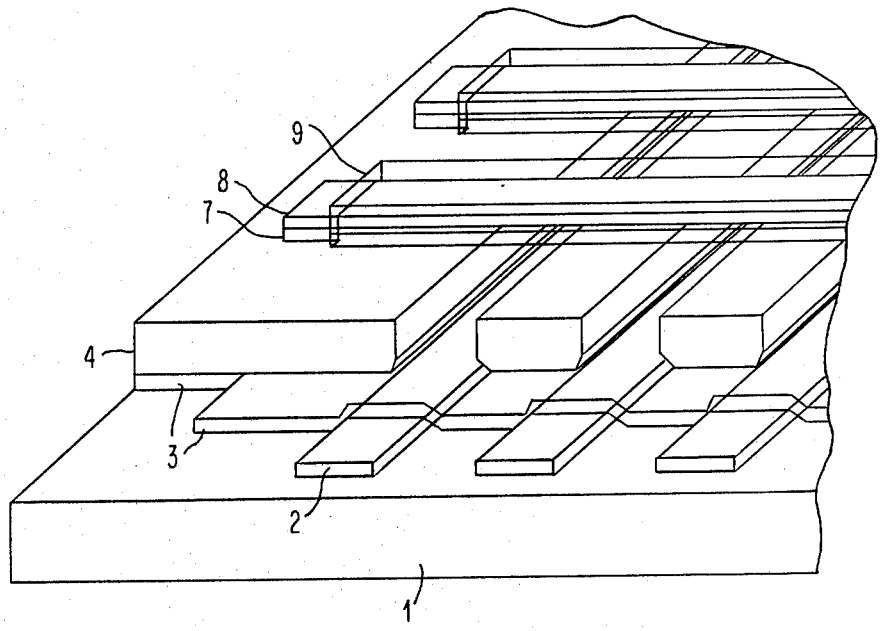
FIG. 5 is an enlarged fragmentary perspective view illustrating the gas display panel fabricated in accordance with the present invention, with the cover plate and the dielectric coatings partly removed.

FIG. 5 is an enlarged fragmentary perspective view illustrating the gas display panel fabricated in accordance with the present invention with the cover plate 13 removed. In FIG. 5, for the purpose of clarity, the dielectric coatings 7 and 9 remaining between the exposed edges of the conductors 2 and the spacer layer 4 are removed. The conductors 2 and 8 are completely dielectrically coated except for the exposed edges for external connections.

While a preferred embodiment of the present invention has been described heretofore, it should be understood that various modifications may be made therein.

For example, while the dielectric coating which covers the lower conductors 2 has been deposited by RF sputtering a dielectric material such as $SiO_2$ in the preferred embodiment of the present invention, it may be provided also by oxidizing the surfaces of the lower conductors to form oxide coatings thereon prior to the deposition of the spacer layer. In this alternative method, aluminium, tantalum, niobium, zirconium, or hafnium may be used as a metal for the lower conductors 2. For example, an aluminium layer is deposited on the glass plate 1, the parallel conductors 2 of aluminium are formed therein by employing the well known photolithographic masking and etching techniques as described with reference to FIG. 1, and then only the surfaces of the aluminium conductors are anodized to be dielectrically coated with alumina. Alternatively, instead of forming the parallel conductors of aluminium by etching, the aluminium layer on the glass plate 1 may be anodized in strips to form parallel aluminium conductors isolated from each other by the regions anodized in stripes, and then only the surfaces of the aluminium conductors may be anodized. The order of these steps of anodizing the aluminium layer for the lower conductors in stripes and anodizing the surface of said aluminium layer may be reversed. When the step of anodizing the surface of the aluminium layer is performed prior to the step of anodizing the aluminium layer in stripes, the aluminium layer for the lower conductors and the spacer layer deposited thereon may be simultaneously anodized in stripes. The subsequent steps may be performed in accordance with the same procedures as described with reference to FIG. 1.

Also, in this alternative method, tantalum, zirconium, niobium or hafnium may be used for the spacer layer. However, when the steps after the step of anodizing the spacer layer are performed as in the case of FIG. 1, the dielectric coatings 7 and 9 should be made of $Al_2O_3$, $Si_4N_4$, etc. since $SiO_4$ is etched by hydrofluoric acid as stated above. A solution of HF or ($HF+HNO_3$) is an appropriate etching solution for tantalum, zirconium, niobium and hafnium. Since these etching solutions do not etch the oxides of these metals, any of these metals may be utilized as a metal to be oxidized on its surface and also as a spacer layer. Further, since the etching solution for aluminium, namely as aqueous solution of ($H_3PO_4+HNO_3$), does not etch the oxides of tantalum or the like, tantalum or the like may be used as a metal to be oxidized on its surface and aluminium may be used as a spacer layer.

Further, although the step of depositing the dielectric coating 7 and the step of depositing the dielectric coating 9 have been used to form dielectric coatings on the upper conductors 8 in the preferred embodiment, more than one of these steps may be eliminated by anodizing the exposed surfaces of the upper conductors 8 to form dielectric coatings on the upper conductors after etching the aluminium areas 6 of the spacer layer 4. In this case, tantalum, niobium, zirconium or hafnium may be used for the upper conductors. Since these metals are not substantially etched by an etching solution for aluminium, they do not suffer damage by the etching solution during the etching of the aluminium areas 6 of the spacer layer 4. In this alternative method, the steps from the formation of the lower conductors to the selective anodization of the aluminium spacer layer may be made in accordance with the procedures stated with reference to FIG. 1 or in accordance with the procedures utilizing the above mentioned surface oxidization of the lower conductors. When the surface oxidization of the lower conductors is employed in this alternative method, both of the lower and upper conductors would be opaque.

Also in this alternative method, the spacer layer may be formed of tantalum, niobium, zirconium or hafnium. However, in this case, the upper conductors should be formed of aluminium since the upper conductors also formed of tantalum, niobium, zirconium or hafnium would be also etched during the etching of the spacer layer. The etching solution for tantalum or the like such as a solution of ($HF+HNO_3$) does not substantially etch aluminium. However, when tantalum or the like is used for the spacer layer, the dielectric materials which would be etched by hydrofluoric acid cannot be used for the dielectric coating 3 on the lower conductors.

Further, it is also possible to eliminate the step of depositing the dielectric coating 3 on the lower conductors and more than one of the steps of depositing the dielectric coating 7 and depositing the dielectric coating 9 and to form dielectric coatings by simultaneously anodizing the exposed surfaces of the lower conductors 2 and the upper conductors 8 after the etching of the aluminium areas 6 of the spacer layer 4. In this case, the lower conductors 2 and the upper conductors 8 are formed of tantalum, niobium, zirconium or hafnium which are not etched by an etching solution for aluminium. Also in this case, both of the lower and upper conductors are opaque. As stated before, when the method of forming the lower conductors isolated from each other by anodizing the metallic layer on the glass plate 1 in stripes is utilized in this alternative method, the anodizations in stripes of the metallic layer for the lower conductors and the aluminium spacer layer may be performed simultaneously.

Also in this case, tantalum or the like may be used for the spacer layer. However, in this case, aluminium should be used for the lower and upper conductors and the dielectric coating 7 or 9, if used, should be formed of a material which would not be etched by hydrofluoric acid used for etching tantalum or the like.

Another alternative method may be used wherein a tantalum layer, for example, is deposited on the glass plate 1, the aluminium spacer layer is deposited thereon, the tantalum layer and the aluminium spacer layer are simultaneously anodized in stripes, and the surface of the tantalum layer is anodized after the etching of the aluminium areas 6.

Although the present invention has been described with reference to particular embodiments thereof, it would be easily understood that various other modifications are possible within the scope of the present invention. For example, although all the areas of the metallic spacer layer between the lower conductors have been oxidized in stripes to provide the ultimate spacer means, it would be easily understood that only the discontinuous areas of each area of the metallic spacer layer between the lower conductors, which would be necessary for supporting the upper conductors so that they may be suspended from the lower conductors, can be anodized to remove all the other areas. In this case, however, the anodizations of the metallic layer for the lower conductors and the spacer layer cannot be performed simultaneously. Further, although the lower and upper conductors have been exposed respectively on one side thereof for external connections in the preferred embodiment, the alternate edges of the conductors may be exposed on opposite sides to facilitate external connections of high line densities. The cover plate may be used for the display face.

Further, while the preferred embodiment of the invention has been described in terms of a gaseous discharge display, it will be apparent that the teaching of the present invention relating to selective removal of a spacer layer to form spaces for insertion of a voltage responsive display medium between opposing electrodes could also be applied to other flat display panels such as liquid crystal displays. Accordingly, it is intended that the scope of the invention be limited only as specified in the claims.

What is claimed is:

1. A method of fabrication a flat display panel which includes first and second parallel conductor arrays disposed substantially orthogonal to each other to define display cells at intersections of said first and second parallel conductor arrays and further includes a voltage responsive gaseous display medium between said first and second conductor arrays at least at the intersections thereof, the method including the sequential steps of:

preparing an insulating substrate with said first parallel conductors formed thereon, forming a first dielectric coating over said first parallel conductors, forming over said first dielectric coating a spacer layer which includes first areas of a material removable by a predetermined treatment and second areas of a material unremovable by said treatment, said first areas including at least regions where the display cells are to be defined and said second areas including at least regions between said display cell regions in a direction parallel to said first parallel conductors, forming over said spacer layer a second dielectric layer, forming over said second dielectric layer said second parallel conductor array orthogonal to said first array and to said first areas exposed therebetween, removing said first areas of said spacer layer by subjecting said exposed portions to selective etching to thereby define said display cells between said first and second parallel conductors, and attaching a cover plate to maintain said gaseous display medium in the display cell regions.

2. The method of claim 1 wherein said first areas consist of a metal and said second areas consist of an oxide of said metal and wherein said predetermined treatment is etching.

3. The method of claim 1 wherein said spacer layer forming step comprises depositing a metal layer over said first parallel conductor array and oxidizing selected areas thereof which do not include the display cell regions but include regions between the display cell regions in the direction parallel to but between said second parallel conductors, and wherein said removing step comprising etching the unoxidized areas of said metal layer.

4. The method of claim 1 further including between the forming and the removing steps the step of oxidizing the exposed surfaces of the second conductors.

5. The method of claim 1 wherein said spacer layer forming step comprises depositing a metal layer over said first parallel conductors and oxidizing regions between said display cell regions in the direction of said second parallel conductors.

6. The method of claim 5 wherein said metal layer is aluminum and said oxidizing step is performed by anodization with a mask to expose the selected regions of said aluminum layer.

7. The method of claim 5 wherein the periphery of said metal layer is oxidized in a frame pattern, and wherein said cover plate is attached and sealed at the area of the oxidized frame periphery.

8. A method of fabricating a gas panel which includes first parallel and second parallel conductor arrays disposed substantially orthogonal to each other whereby the intersections define display cells and further includes an ionizable gas between said first and second parallel conductors at least at the intersections thereof, the method including the sequential steps of:

preparing an insulating substrate with said first parallel conductors formed thereon, forming a first dielectric coating over said first parallel conductors, forming over said first dielectric coating a spacer layer which includes first areas of a material removable by a predetermined treatment and second areas of a material unremovable by said treatment, said first areas including at least regions where the display cells are to be defined and said second areas including at least regions between the display cell regions in a direction parallel to but between said second parallel conductors, forming a second dielectric coating over said spacer layer, forming over said second dielectric coating said second parallel conductors such that a portion of each of said first and second areas is exposed therebetween, removing said first areas of said spacer layer by subjecting the exposed portions to a selective etching treatment to thereby provide said display cells between said first and second parallel conductors at least at the intersections thereof, and attaching a cover plate to provide the ionizable gas in said display cell areas.

9. The method of claim 8 further including between said substrate preparing step and said spacer layer forming step the step of coating the exposed surfaces of said first conductors with a dielectric.

10. The method of claim 8 further including between said removing and attaching steps the step of coating with a dielectric the exposed surfaces of said first and second conductors.

11. A method of fabricating a gas panel which includes dielectrically coated first and second parallel conductor arrays disposed substantially orthogonal to each other to define display cells at intersections of said first and second conductors and further includes an ionizable gas between said first and second conductors at least at the intersections thereof, the method including the sequential steps of:

preparing an insulating substrate with said dielectrically coated first conductor array formed thereon, depositing a metal layer on said first dielectrically coated conductor array, oxidizing selected areas of said metal layer including regions between said display cell regions in a direction parallel to the dielectrically coated conductors of said second conductor array, forming on the selectively oxidized metal layer the dielectrically coated second conductor array such that a portion of each of the unoxidized areas of the metal layer is exposed therebetween, etching said unoxidized areas by bringing the exposed portions into contact with an etchant which does not substantially attack areas other than the unoxidized areas thereby to define said display cells between said first and second conductors at least at the areas of the intersections, and attaching a cover plate to maintain said ionizable gas in said display cell areas.

12. The method of claim 11 wherein said metal layer is aluminum and said oxidizing is performed by anodization with a mask to expose the selected areas of said aluminum layer.

13. The method of claim 11 wherein said dielectrically coated second parallel conductor array forming step comprises depositing a dielectric layer on said selectively oxidized metal layer, depositing parallel conductors extending in a direction orthogonal to said first conductors on said dielectric layer, depositing a second dielectric layer over said conductors, and etching those areas of both dielectric layers which are between the deposited parallel conductors to expose a portion of each of said unoxidized areas.

* * * * *